United States Patent [19]

Wichman et al.

[11] 4,182,494

[45] Jan. 8, 1980

[54] ANTI SIDE SPLASH DRIVE ARM FOR AN IMPACT DRIVE SPRINKLER

[75] Inventors: William J. Wichman, Glendora; Robert W. Patterson, Huntington Beach, both of Calif.

[73] Assignee: Anthony Manufacturing Corp., Azusa, Calif.

[21] Appl. No.: 877,375

[22] Filed: Feb. 13, 1978

[51] Int. Cl.[2] ..... B05B 3/14

[52] U.S. Cl. ..... 239/230; 239/233

[58] Field of Search ..... 239/206, 230–233, 239/500, 507, 509–512, 521, 522, 222.15

[56] References Cited

U.S. PATENT DOCUMENTS

| | | | |
|---|---|---|---|
| 3,022,012 | 2/1962 | Sharp et al. | 239/230 |
| 3,208,672 | 9/1965 | Sully | 239/230 |
| 3,408,009 | 10/1968 | Friedmann et al. | 239/230 |
| 3,918,643 | 11/1975 | Malcolm | 239/230 |
| 3,952,953 | 4/1976 | Eby | 239/230 |
| 3,955,762 | 5/1976 | Cassimatis et al. | 239/230 |
| 3,977,610 | 8/1976 | Royer | 239/230 |

*Primary Examiner*—Johnny D. Cherry

*Attorney, Agent, or Firm*—Fulwider, Patton, Rieber, Lee & Utecht

[57] ABSTRACT

For use with an impact drive sprinkler of the full or part circle type, an anti side splash drive arm is provided comprising a reaction member on the arm which includes a first curved portion for deflecting a stream of water ejected from a nozzle on the sprinkler through a first obtuse angle, and a second curved portion, spaced laterally from and behind the first curved portion, for deflecting the stream of water through a second obtuse angle approximately equal to the first whereby the deflected water stream emerges substantially parallel to the stream of water ejected from the nozzle.

15 Claims, 7 Drawing Figures

ANTI SIDE SPLASH DRIVE ARM FOR AN IMPACT DRIVE SPRINKLER

BACKGROUND OF THE INVENTION

This invention relates generally to irrigation sprinklers of the impact drive type, and, more particularly, to an impact arm for such a sprinkler which is relatively compact in size and is capable of driving the sprinkler in both the forward and reverse directions when operated at relatively low supply pressures.

As is well known in the art, it is highly desirable for a part circle, impact drive sprinkler to be provided with a means by which the stream of water which acts upon the impact arm of the sprinkler is ejected by the impact arm in a direction substantially parallel to the stream of water ejected by the sprinkler nozzle. In this way, undesirable side or back splash from the sprinkler is minimized, and the sprinkler irrigates only the area intended to be irrigated. One highly successful sprinkler intended to solve this problem is that described and claimed in U.S. Pat. No. 3,022,012, which issued on Feb. 20, 1962 to C. R. Sharp et al. Although sprinklers constructed in accordance with the Sharp et al patent operate satisfactorily, for a given size sprinkler and nozzle diameter, there is a minimum water supply pressure above which water must be supplied to that sprinkler in order to achieve satisfactory water distribution and sprinkler operation.

By way of example, as shown in the 1977–1978 Irrigation Equipment Catalog published by Rain Bird Sprinkler Mfg. Corp. of Glendora, Calif., for a part circle Model 25 PJ sprinkler with a nozzle size of $\frac{1}{8}$ inch, a minimum supply pressure of 35 pounds per square inch (psi) is required to achieve satisfactory water distribution and sprinkler operation. If the pressure is allowed to fall below this required level, the stream of water ejected from the nozzle of the sprinkler may not impart sufficient energy to the drive arm to properly drive the sprinkler in the forward and reverse directions. Moreover, a part circle impact drive sprinkler requires a higher supply pressure than a full circle sprinkler because, at each end of the preselected arc within which the part circle sprinkler operates, the sprinkler must be driven with sufficient energy not only to drive the sprinkler in the desired direction, but also to actuate the reversing mechanism of the sprinkler. Large amounts of energy are required to maintain the supply pressure necessary to effect satisfactory drive operation of the sprinkler in the forward and reverse directions.

This is particularly true in large agricultural applications, such as the well known pivot move type sprinkler systems, where it is often necessary to provide high capacity supply pumps typically run by natural gas or electricity, and often even booster pumps along the supply line in order to maintain the required pressure. The cost of the energy consumed by high capacity supply pumps, in addition to the booster pumps, significantly increases the cost of operating such sprinkler systems.

In addition, it is highly desirable for full or part circle impact drive sprinklers to be relatively compact in size. This is particularly true of sprinklers intended for pop-up operation within a generally cylindrical subterranean housing. In a pop-up application, a smaller sprinkler can be contained in a smaller housing thereby presenting a desirable less conspicuous appearance while requiring less material to produce, and therefore being relatively inexpensive to manufacture.

Accordingly, there exists a need for a convenient, effective and economical device which can be contained within a relatively inexpensive small housing, and which is capable of operating at energy saving low pressures. As will become apparent from the following, the present invention satisfies that need.

SUMMARY OF THE INVENTION

The present invention resides in a new and improved drive arm for an impact drive sprinkler which occupies relatively little space and is capable of effectively driving the sprinkler in the forward and reverse directions when operating at relatively low supply pressures. This is accomplished generally by a new and improved reaction member on the arm which deflects the stream of water ejected from the nozzle of the sprinkler through a first obtuse angle thereby directing the stream rearwardly with respect to its original direction, and then through a second obtuse angle, approximately equal to the first obtuse angle, and ejects the stream of water in a direction substantially parallel to the stream ejected from the nozzle.

More specifically, the impact arm of the present invention includes a reaction member having a first curved portion which receives the stream of water from the nozzle and deflects the stream through a first obtuse angle so that the stream moves rearwardly toward a second curved portion located behind and laterally spaced from the first curved portion. The second curved portion deflects the stream in the opposite direction through substantially the same obtuse angle and ejects the stream in a direction substantially parallel to the direction of the stream ejected from the nozzle. In one manner of accomplishing the desired compact configuration of the impact arm, the second curved portion and the first curved portion are located at substantially the same radial distance from the center of rotation of the impact arm.

By this arrangement, a sprinkler constructed in accordance with the present invention is capable of operating effectively in both full and part circle applications when water is supplied at energy saving low pressures. Further, the drive arm of the present invention is compact in size and effectively eliminates undesirable side splash during operation of the sprinkler.

Other features and advantages of the present invention will become apparent from the following detailed description, taken in conjunction with the accompanying drawings, which illustrate, by way of example, the principals of the invention.

DETAILED DESCRIPTION

As shown in the exemplary drawings, the present invention is embodied in an impact drive water sprinkler 10 which is intended to minimize side splash or side spray during full or part circle sprinkler operation. In this instance, the sprinkler 10 is shown mounted for pop-up operation to the upper end portion of a tubular riser 12 disposed for reciprocation between raised and lowered positions within a subterranean cylindrical housing 14, the sprinkler being recessed fully within the housing when not in use and being raised above the housing to the position shown in FIG. 1 when in operation.

Figure 1:
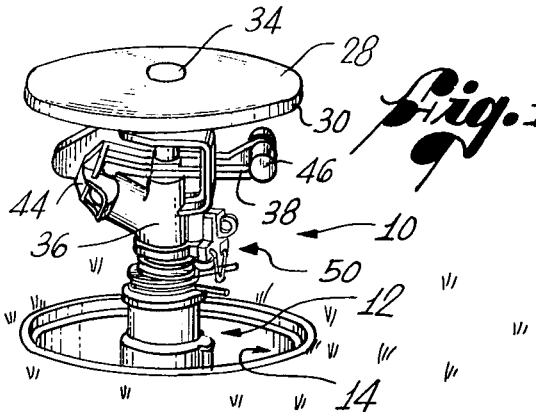
FIG. 1 is a perspective view of a part circle sprinkler embodying the present invention and shown mounted in a subterranean housing for pop-up type operation.
Figure 2:
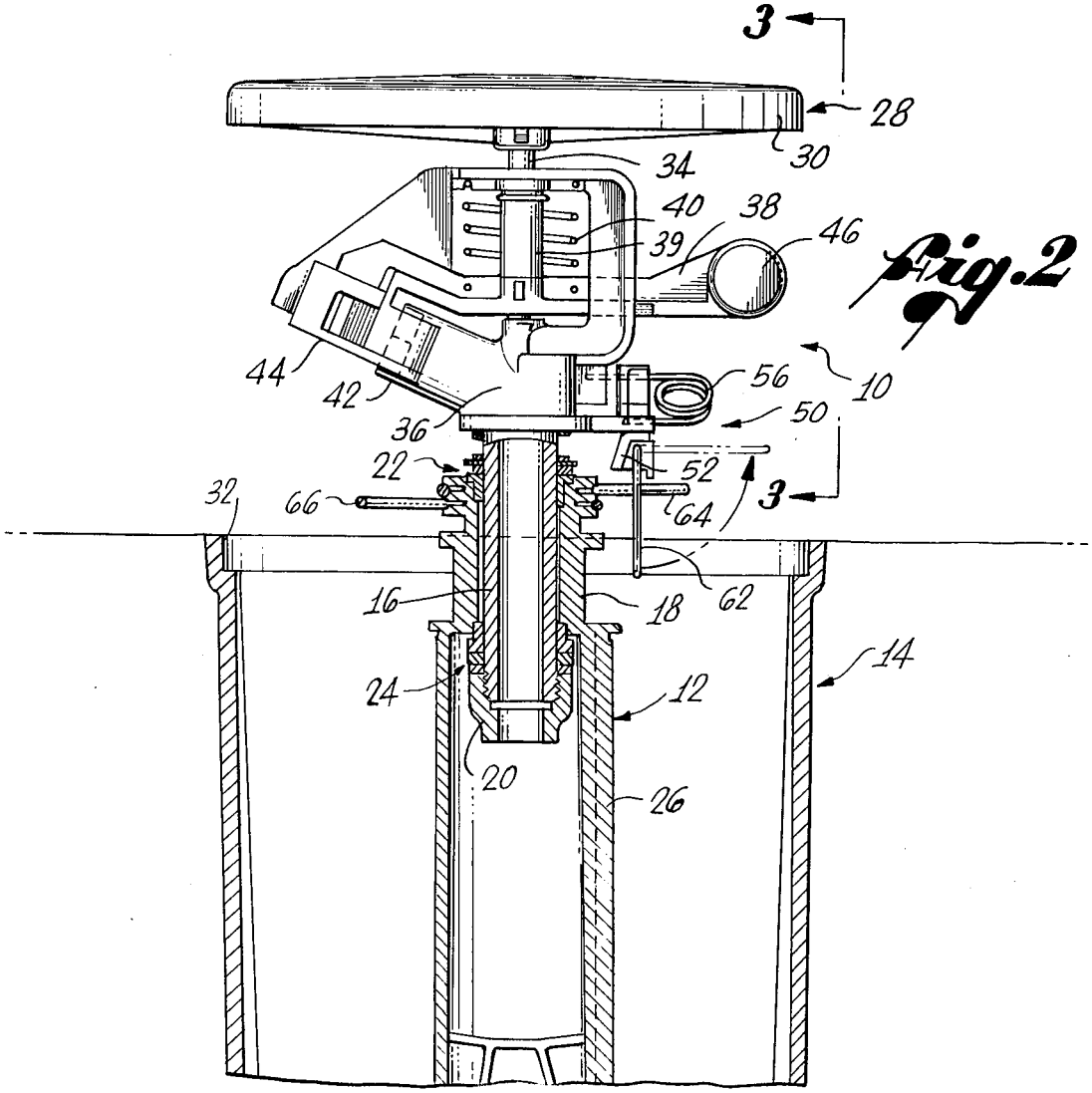
FIG. 2 is an enlarged elevational view, partly in section, of the sprinkler of FIG. 1.
Figure 4:
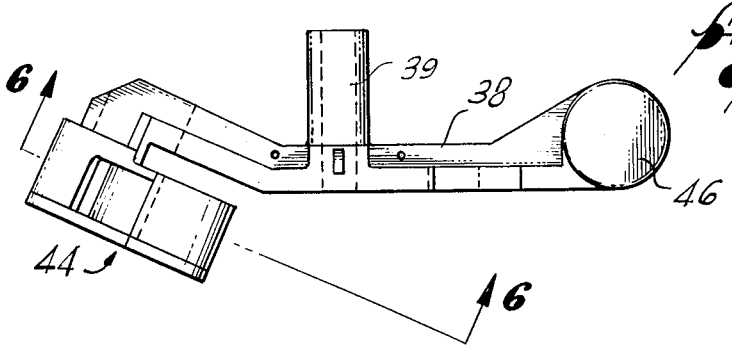
FIG. 4 is an enlarged elevational view of the impact arm of the sprinkler shown in FIGS. 1–3.
Figure 5:
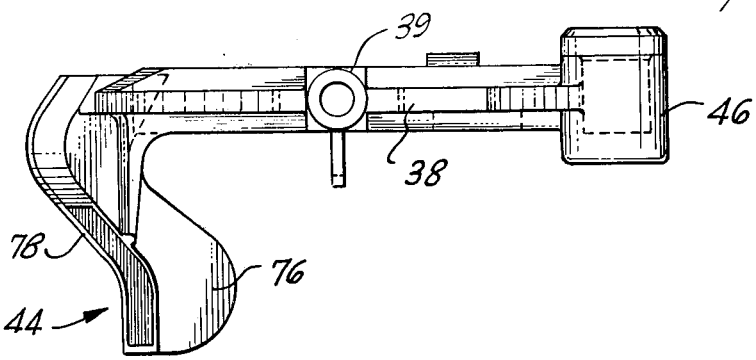
FIG. 5 is a plan view of the impact arm shown in FIG. 4.

As can best be seen in FIGS. 1 and 2, the sprinkler 10 includes a downwardly extending tubular stem 16 disposed within an upper reduced diameter sleeve 18 of the riser 12, and secured within the upper sleeve 18 by a retaining nut 20. The tubular stem 16 is mounted for rotation within the sleeve and coupled with the sleeve through upper and lower bearings 22 and 24 of conventional design. To prevent rotation of the riser 12 relative to the housing 14, the riser has a longitudinal key 26 (shown in broken line) along its length within which rides a mating keyway (not shown) in the housing and which acts to restrain the riser against rotation relative to the housing during operation of the sprinkler 10 and reciprocation of the riser between the operative and inoperative positions.

Figure 7:
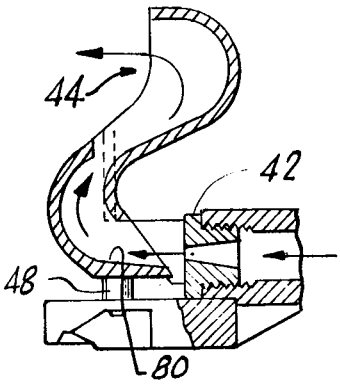
FIG. 7 is a sectional view similar to FIG. 6 but also showing fragmentary portions of a nozzle and sprinkler body.

In common with other sprinklers of the impact-drive type, the sprinkler 10 herein comprises a sprinkler body 36, preferably formed of metal or plastic, an impact arm 38, and an arm spring 40. The sprinkler body 36 receives water through the riser 12 on which it is mounted for rotation, and ejects the water in an upwardly and outwardly direction through a nozzle 42. The impact arm 38 includes a reaction member 44 disposed at one end of the arm, and a counterweight 46 disposed at the other end, and is mounted for rotation about a vertical axis coincident with the vertical axis of rotation of the sprinkler body 36. In this instance, the impact arm 38 includes an upstanding centrally apertured sleeve 39 through which projects a pivot pin 34 about which the impact arm rotates relative to the sprinkler body 36. The arm spring 40 is disposed about the sleeve 39 and is coupled between the impact arm 38 and the sprinkler body 36 in such a manner as to bias the reaction member 44 of the impact arm into alignment with the nozzle 42 and against an anvil 48 (FIG. 7) affixed to the sprinkler body.

To fully protect the sprinkler 10 when not in use, a disk-shaped cover plate 28 overlies the sprinkler, and when the riser 12 and sprinkler are retracted into the housing 14, the rim 30 of the cover plate fits within a lip 32 formed around the inside upper end of the housing. Herein, the cover 28 is centrally mounted on the upper end of the pivot pin 34 which projects above the top of the sprinkler 10, and is free to rotate relative to the sprinkler during operation.

The sprinkler 10 of the present invention is driven in a conventional manner for impact-drive sprinklers. The water stream from the nozzle 42 intercepts the reaction member 44 of the impact arm 38 to effect a rotational deflection of the drive arm and rotate the reaction member in a first direction out of the stream and away from the anvil 48. During the rotational arm deflection, the arm spring 40 is compressed until the force of the spring slows, and ultimately reverses the rotational movement of the impact arm 38. The reaction member 44 of the impact arm 38 then is driven back into the stream and impacts the anvil 48 to thereby apply an increment of angular motion to the sprinkler body 36 in the forward drive direction. Continued oscillation of the impact arm 38 into and out of the stream thereby drives the sprinkler body 36 incrementally in a forward direction about its vertical axis.

Figure 3:
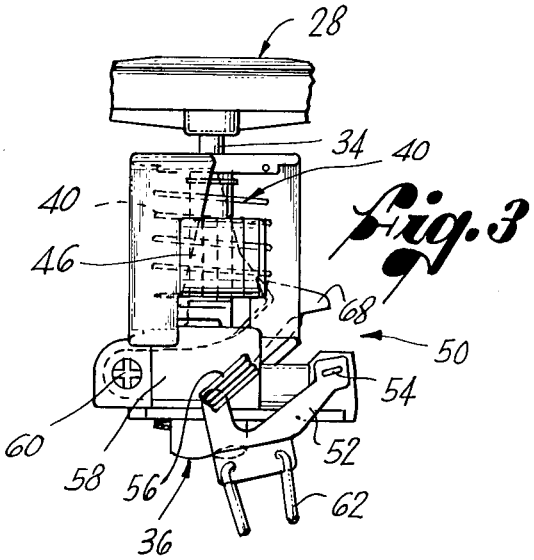
FIG. 3 is a fragmentary elevational view taken substantially along the line 3—3 in FIG. 2, and showing details of a reverse trip mechanism.

To effect part circle operation, the sprinkler 10 includes a reversing mechanism 50 of conventional design, the operation of which can be appreciated from a review of FIGS. 2 and 3. The reversing mechanism 50 includes a trip arm 52 pivotally mounted to the body 36 by a pivot pin 54 and coupled by an over-center spring 56 to a reversing arm 58 also pivotally mounted to the body by a pivot pin 60. The trip arm 52 and reversing arm 58 are coupled together by the over-center spring 56 in such a manner that the trip arm and reversing arm are each movable between two stable positions, and the spring acts to hold the trip arm and reversing arm in one or the other of their two stable positions.

Movement of the trip arm 52 and reversing arm 58 between their stable positions is effected by means of a trip extension 62 which depends downwardly from the trip arm to engage adjustable trip stops 64 and 66 disposed about the upper end portion of the sleeve 18 (FIG. 2). The reversing arm 58 has an upwardly projecting hooked end portion 68 which, when the reversing mechanism 50 is in a reverse position, acts to limit rearward movement of the reaction member 44 of the impact arm 38 away from the water stream.

In this instance, when the reversing mechanism 50 is in the reverse mode, the hooked portion 68 of the reversing arm 58 projects into the rearward path of the impact arm 38 and engages that arm at a point where the reaction member 44 has just left the water stream. At this position of the impact arm 38, the arm spring 40 has been compressed to only a very small degree, and, accordingly the impact arm is at a relatively high energy level when it hits reversing arm 58 during its reverse deflection. This then produces a relatively large impact driving force on the reversing arm 58, and hence the sprinkler body 36, in the reverse direction. Reverse rotation of the sprinkler 36 then continues until the trip extension 62 engages the trip stop 64 to move the reversing arm to its other stable position and retract the hooked portion 68 out of the path of the impact arm 38 whereupon forward rotation is again initiated.

To arrange the sprinkler 10 for full circle operation, the trip extention 62 can be rotated to a substantially horizontal position as shown in broken line in FIG. 2. In this way, the extension 62 will not engage either of the trip stops 64 or 66 and will therefore rotate continuously.

In early impact arm driven sprinkler designs, water impinging upon the reaction member of the impact arm would be sprayed or splashed sideways with respect to the direction of the water stream from the nozzle, thus producing an area of undersirable water spray in locations where watering was not desired. Subsequently, an impact arm was designed to minimize the side splash produced by the reaction member of the arm, and that design is shown and described in the aforementioned U.S. Pat. No. 3,022,012 issued Feb. 20, 1962 to C. R. Sharp et al. Other designs of anti side splash drive arms are shown in the 1977–1978 Irrigation Equipment Catalog published by Rain Bird Sprinkler Mfg. Corp. of Glendora, Calif.

In accordance with the present invention, the reaction member 44 of the impact arm 38 is constructed in such a manner that it increases the amount of driving force in the forward direction over prior art impact drive sprinklers, yet does so in a manner which reduces the overall size of the impact arm necessary to produce the drive force required in prior art sprinklers, and the impact arm 38 is capable of driving the sprinkler 10 in the forward and reverse directions when water is supplied to the sprinkler at relatively low supply pressures. Moreover, the reaction member 44 of the present invention, when used with a part circle sprinkler, operates in a highly effective and reliable manner to produce an impact drive sprinkler 10 which substantially eliminates all undesirable side splash from the sprinkler.

Toward the foregoing ends, the reaction member 44 is herein formed integrally with the impact arm 38, preferably as a single molded or cast piece, and is vertically inclined relative to the sprinkler body 36 so as to form an angle with a horizontal plane through the body which coincides with the ejection angle of the water stream from the nozzle 42. With this arrangement, water ejected from the reaction member 44 during operation will be ejected upwardly and outwardly from the sprinkler 10 in a direction substantially parallel to that of the stream from the nozzle 42. The reaction member 44 includes an entrance end 70 leading to a first curved reaction portion 72 which directs the stream from the nozzle 42 through a first obtuse angle so that the stream is actually moving rearwardly of its original path of travel. Thereafter, the stream engages a second curved reaction portion 74, the entrance to which is disposed rearwardly and laterally away from the first curved portion, and which redirects the stream through a second obtuse angle equal and opposite to the first, to return the stream to a direction parallel to its initial, undeflected direction and ejects the stream from the exit end of the reaction member 44. To confine the stream within the reaction member 44, upper and lower walls 76 and 78, respectively, are provided over the curved reaction portions 72 and 74.

By directing the stream through two successive obtuse angles, the stream must follow a relatively long path length between entry to and exit from the reaction member 44. The increased length of travel results in increased drive in the forward direction over prior impact drive sprinklers while reducing the overall size of the reaction member 44 and impact arm 38, thereby requiring a much smaller area within which to operate and allowing the sprinkler 10 to be housed within a much smaller housing 14 than available heretofore with prior impact drive sprinklers.

More specifically, as the reaction member 44 initially enters the stream from the nozzle 42, the stream engages and attaches to a substantially straight sided leading surface 80 which acts to direct the intercepted stream laterally toward the first curved portion 72 and to pull the reaction member further into the stream. Thereafter, as the reaction member 44 is pulled further into the stream, and the stream further moves into the reaction member, the first curved portion 72 directs the stream laterally and rearwardly through the first obtuse angle and imparts a force to the impact arm 38 tending to pull the reaction member fully into the stream and against the anvil 48.

Due to the relatively long path length traveled by the stream from the first curved portion 72 to the second curved portion 74, the reaction member 44 impacts against the anvil 48 fully before the stream has had sufficient time to reach the second curved portion. As a result of this initial stream redirection, the reaction member 44 impacts against the anvil 48 with a force greater than prior art sprinklers of the same general type.

Figure 6:
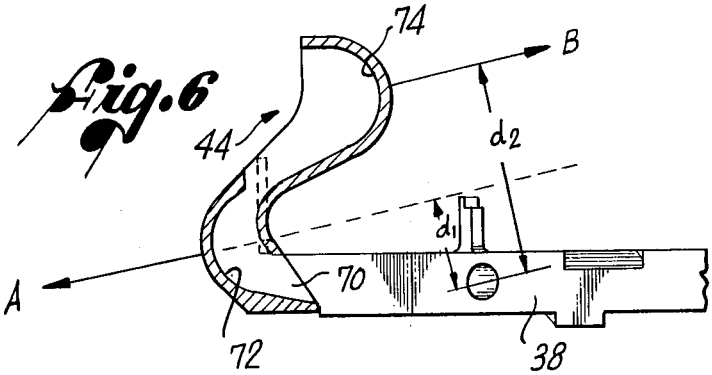
FIG. 6 is a sectional view taken substantially along the line 6—6 in FIG. 4.

By directing the stream rearwardly of its original path of travel and then redirecting it to a path substantially parallel to its original path, the stream exerts a force on the reaction member 44 sufficient to deflect the reaction member, against the force of the arm spring 40, out of the stream ejected from the nozzle 42. The resultant force which the stream exerts upon the reaction member 44 as it passes through the first curved portion 72 acts along a line which passes relatively close to the center of rotation of the impact arm 38 and is represented diagrammatically in FIG. 6 by the arrow A which acts along a line passing a perpendicular distance $d_1$ from the center of rotation of the arm 38.

As the stream passes through the second curved portion 74, it is deflected through the second obtuse angle, which is substantially equal and opposite to the first obtuse angle, and ejected by the reaction member 44 in a direction substantially parallel to the original undeflected direction of the stream ejected from the nozzle 42. As a result of this deflection, the stream exerts a resultant force on the second curved portion 74 which is opposite in direction and acts along a line substantially parallel to the direction of the resultant force represented by the arrow A. The resultant force which the stream exerts upon the second curved portion 74 is represented diagrammatically in FIG. 6 by the arrow B which acts along a line substantially parallel to the direction of arrow A and passes a perpendicular distance $d_2$ from the center of rotation of the arm 38.

Since each curved portion of the reaction member 44 deflects the same stream of water, travelling at substantially the same velocity, through the same angle, the magnitude of the forces represented by the arrows A and B are substantially the same. Accordingly, the torque exerted on the arm 38 in a clockwise direction as viewed in FIG. 6, for deflecting the reaction member 44 away from the anvil 48 and out of the stream ejected from the nozzle 42, is equal to the magnitude of the force represented by either arrow A or B multiplied by the difference between the distances $d_1$ and $d_2$.

From the foregoing it can be seen that by increasing the angle through which the first curved portion 72 deflects the stream substantially beyond 90 degrees, the line along which the resultant force acts upon the first curved portion 72 is moved closer to the center of rotation of the arm 38 causing the value of $d_1$ to approach zero. As $d_1$ approaches zero, the full effect of the force represented by the arrow B acting at the distance $d_2$ applies the torque for moving the reaction member 44 out of the stream ejected from the nozzle 42. By this arrangement, the torque necessary for moving the reaction member 44 out of the stream, against the force of the arm spring 40, can be achieved while allowing the second curved portion 74 to be located relatively close to the center of rotation of the arm 38 thereby providing the desirable reduced size of the arm 38.

In order to accomplish the desired compact size and performance of the arm 38 while providing for its convenient manufacture, the angle through which each of the curved portions 72 and 74 deflects the stream of water can be between about 120 and 180 degrees, and the preferred angle is about 150 degrees. If the curved portions 72 and 74 deflect the stream through an angle of less than 120 degrees, the reaction member 44 would project a relatively great distance from the center of rotation of the arm 38, and the sprinkler 10 could not be contained within a relatively small housing 14, as desired. Although a reaction member that deflects the stream through angles of greater than 180 degrees would be operable, this arrangement is believed to be inordinately complex for convenient manufacture.

In addition to its desirable compact size, the sprinkler of the present invention is capable of operating at relatively low supply pressures. This distinct advantage is due, at least in part, to the greatly reduced rotational moment of inertia of the impact arm 38 about its axis of rotation in the sleeve 39, which is a result of locating the reaction member 44 at a relatively short radial distance from the center of rotation of the impact arm 38 rather than extending away from the center of rotation as in prior art impact drive sprinklers. In the preferred embodiment of the present invention, the first and second curved portions 72 and 74 are located at substantially the same radial distance from the center of rotation of the arm 38. The rotational moment of inertia can be reduced even further by constructing the impact arm 38 of a relatively light material such as molded plastic.

Excellent results have been achieved at desirable relatively low supply pressures using the sprinkler of the present invention. For example, a part circle Model 25 PJ sprinkler manufactured by Rain Bird Sprinkler Mfg. Corp. of Glendora, Calif., employing a nozzle having a 7/64 inch bore, required a minimum supply pressure of 40 pounds per square inch (psi) in order for the drive arm to satisfactorily drive the sprinkler in both the forward and reverse directions. By comparison, a comparable sprinkler constructed according to the present invention with a molded plastic drive arm, also employing a nozzle having a 7/64 inch bore, was capable of driving satisfactorily in both the forward and reverse directions at a supply pressure of only 12.5 psi.

A similar test was run on sprinklers employing a nozzle having a $\frac{1}{8}$ inch bore, and the 25 PJ sprinkler required a minimum operating (drive) pressure of 24 psi while the sprinkler constructed according to the present invention required only 9.5 psi. Therefore, proper driving operation of an impact arm sprinkler can be achieved at a supply pressure reduction of over 60% by employing a drive arm constructed in accordance with the present invention. Such a significant reduction in the supply pressure required to operate a sprinkler will result in a substantial saving of energy consumed in the operation of a sprinkler system.

In anti splash sprinklers known heretofore, the reaction member on the drive arm projects generally away from the sprinkler nozzle, and a small quantity of water is splashed laterally as the leading edge of the reaction member enters and passes through the stream. In a sprinkler constructed in accordance with the present invention, however, any side splash which may occur as the leading surface 80 enters and passes through the stream will be projected against the outside wall of the second curved portion 74 and fall to the ground directly below the sprinkler, thereby entirely eliminating undesirable side splash.

It will be appreciated from the foregoing description that the present invention represents a significant advance in the field of impact arm sprinklers. In particular, the invention provides an impact arm sprinkler which minimizes side splash, and which is of extremely compact design suitable for installation in pop-up type sprinklers. Further, the sprinkler 10 of the present invention is capable of operating in both the forward and reverse directions at relatively low supply pressure.

While a particular form of the invention has been illustrated and described, it will be apparent that various modifications can be made without departing from the spirit and scope of the invention.

We claim:

1. In an impact drive sprinkler of the type having a body with a sprinkler nozzle through which water is ejected from the sprinkler in a forward direction, and an oscillating spring biased impact arm having a reaction member which is repeatedly deflected laterally away from a rest position intercepting the water ejected by the nozzle, then biased back to the rest position to impact the body and effect rotation of the body through a preselected arc by small angular increments, the improvement comprising:

a rearwardly facing arcuate deflector surface on the reaction member for diverting water issuing from the nozzle through a first angle of at least about 120 degrees laterally and rearwardly from said forward direction; and a forwardly facing arcuate deflector surface on the reaction member for receiving diverted water from said rearwardly facing deflector surface and having a portion disposed a substantial distance rearwardly of said rearwardly facing deflector surface for redirecting the diverted water forwardly to a direction substantially parallel with said forward direction, whereby water issuing from the nozzle is substantially confined to the preselected arc through which the sprinkler is rotated.

2. The improvement as set forth in claim 1 wherein said first angle is between about 120 and 180 degrees.

3. The improvement as set forth in claim 1 wherein said first angle is about 150 degrees.

4. The improvement as defined in claim 1 wherein said forwardly facing deflector surface redirects the diverted water through a second angle of at least about 120 degrees.

5. The improvement as defined in claim 4 wherein said rearwardly facing deflector surface and said forwardly facing deflector surface are integrally formed adjacent each other on said reaction member and smoothly divert water issuing from said nozzle through two successive and reversed obtuse angles of at least about 120 degrees each.

6. The improvement as defined in claim 5 including upper and lower spaced wall means overlying said rearwardly facing deflector surface and said forwardly facing deflector surface for confining deflected water within said reaction member.

7. The improvement as defined in claims 1 or 6 wherein said impact drive sprinkler is a part circle sprinkler.

8. The improvement as defined in claims 1 or 6 wherein said reaction member is made of plastic.

9. An anti-side splash reaction member for use with an impact arm of an impact drive sprinkler from which water issues in a forward direction, said reaction member comprising:

first arcuate surface means for diverting water from said sprinkler rearwardly through an obtuse angle of at least about 120 degrees; and second arcuate surface means spaced rearwardly from said first means and receiving diverted water therefrom, said second means rediverting received water through a second obtuse angle of at least about 120 degrees to a forward direction substantially parallel to the direction of undiverted water from said sprinkler.

10. An anti-side splash reaction member as defined in claim 9 wherein said first and second obtuse angles are each about 150 degrees.

11. An anti-side splash reaction member as defined in claim 9 including upper and lower spaced wall means overlying said first and second arcuate surface means for confining diverted water within said reaction member.

12. An anti-side splash reaction member as defined in claim 9 wherein said reaction member is made of plastic.

13. An anti-side splash reaction member for use with an impact arm of an impact drive sprinkler, said reaction member comprising:

a pair of adjacent arcuate deflecting surface means for smoothly diverting water issuing from the sprinkler through two successive and reversed obtuse angles of at least about 120 degrees each.

14. An anti-side splash reaction member as defined in claim 13 wherein each of said obtuse angles is about 150 degrees.

15. An anti-side splash reaction member as defined in claim 13 wherein said reaction member is made of plastic.

* * * * *